US006159589A

United States Patent [19]

Isenberg et al.

[11] Patent Number: 6,159,589

[45] Date of Patent: Dec. 12, 2000

[54] INJECTION MOLDING OF LONG FIBER REINFORCED THERMOPLASTICS

[75] Inventors: Paul C. Isenberg, Reading, Pa.; Christopher J. Beard, Bristol, Conn.; Nick R. Schott, Westford, Mass.

[73] Assignee: H.H. Brown Shoe Company, Greenwich, Conn.

[21] Appl. No.: 08/978,668

[22] Filed: Nov. 26, 1997

Related U.S. Application Data

[63] Continuation of application No. 08/577,118, Dec. 22, 1995, abandoned.

[51] Int. Cl.[7] ..... A43C 13/14

[52] U.S. Cl. ..... 428/220; 442/103; 442/104; 442/148; 442/180; 442/327; 36/77 R; 36/77 M; 36/72 R

[58] Field of Search ..... 36/77 R, 77 M, 36/72 R; 442/327, 103, 104, 148, 180; 428/220

[56] References Cited

U.S. PATENT DOCUMENTS

| | | | |
|---|---|---|---|
| 2,740,209 | 4/1956 | Shultz | 36/77 |
| 3,045,367 | 7/1962 | McKeon | 36/72 |
| 3,950,865 | 4/1976 | Gray | 36/77 |
| 4,103,438 | 8/1978 | Fron | 36/72 |
| 4,735,003 | 4/1988 | Dykeman | 36/77 |
| 5,210,963 | 5/1993 | Harwood | 36/77 |
| 5,331,751 | 7/1994 | Harwood | 36/77 |
| 5,560,985 | 10/1996 | Watanabe et al. . | |

FOREIGN PATENT DOCUMENTS

| | | | |
|---|---|---|---|
| 0100181 | 7/1983 | European Pat. Off. | A43B 7/32 |
| 2071989 | 3/1981 | United Kingdom | A43B 23/16 |
| 2138272 | 10/1984 | United Kingdom | A43B 21/16 |

OTHER PUBLICATIONS

"Injection Molding of Long Fiber Reinforced Thermoplastics for New Product Development and Proof of Concept" Christopher J. Beard; Master thesis; University of Massachusetts—Lowell; Apr. 1995 pp. 1–102.

"How to Process Long–Fiber Reinforced Thermoplastics" Plastics Technology; Apr. 1988; pp. 83–89.

"Fibre Degradation During Processing of Short Fibre Reinforced Thermoplastics" Franzen et al. Composites, vol. 20, No. 1; Jan. 1989; pp. 65–76.

"Fiber Fracture in Reinforced Thermoplastics Processing" von Turkovich et al; Polymer Engineering and Science; Sep., 1993; vol. 23, No. 13; pp. 743–749.

"Short–Fiber–Reinforced Thermoplastics. Part III: Effect of Fiber Length on Rheological Properties and Fiber Orientation" Vaxman et al; Polymer Composites, Dec. 1989, vol. 10, No. 6; pp. 454–462.

"High Speed Pultrusion of Thermoplastic Composites" Taylor et al; Presented at the 22nd International SAMPE Technical Conference; Nov. 6–8, 1990; pp. 10–21.

"A Study of Fibre Attrition in the Processing of Long Fibre Reinforced Thermoplastics" Bailey et al Intern. Polymer Processing 2; 1987; pp. 94–101.

"Mechanical Degradation of Glass Fibers During Compounding with Polypropylene" B. Fisa; Polymer Composites, Oct., 1985, vol. 6, No. 4; pp. 232–241.

"Structure and Mechanical Properties in Injection Moulded Discs of Glass Fibre Reinforced Polypropylene" Darlington et al; Polymer, vol. 18, Dec.; 1977, pp. 1269–1274.

"Jetting and Fibre Degradation in Injection Moulding of Glass Fibre Reinforced Polyamides" Akay et al Journal of Materials Science, 27, 1992; pp. 5831–5836.

"Morphological and Orientation Studies of Injection Moulded Nylon 6,6/Kevlar Composites" Yu et al; Polymer, vol. 35, No. 7; 1994; pp. 1409–1418.

"Bending and Breaking Fibers in Sheared Suspensions" Salinas et al Polymer Engineering and Science, Jan., 1981; vol. 21, No. 1; pp. 23–31.

"Young's Modulus Variations Within Short Glass Fibre Reinforced Nylon 6,6 Injection Mouldings" O'Donnell et al Plastics, Rubber and Composites Processing and Applications, vol. 22, No. 2, 1994; pp. 69–77.

"Statistical Considerations For Three–Dimensional Fiber Orientation Distribution in Injection–Molded, SHort Fiber Reinforced Transparent Thermoplastics"; Lian et al; pp. 608–612, ANTEC '95.

Presentation; Massachusetts, Lowell; Apr. 1995: Christopher Beard.

*Primary Examiner*—Elizabeth M. Cole

*Attorney, Agent, or Firm*—Hayes, Soloway, Hennessey, Grossman & Hage, P.C.

[57] ABSTRACT

An injection molded fiber-impregnated thermoplastic composite material comprising a plastic polymer matrix wherein the fibers are sufficiently interwoven and entangled in said polymer matrix to provide improved resistance to mechanical loading, and wherein said composite material is particularly suited for the preparation of an injection molded toe cap for a protective shoe.

8 Claims, No Drawings

INJECTION MOLDING OF LONG FIBER REINFORCED THERMOPLASTICS

This is a continuation of copending application Ser. No. 08/577,118 filed on Dec. 22, 1995, now abandoned.

BACKGROUND OF THE INVENTION

The present invention relates to the injection molding of fiber reinforced thermoplastics, containing a substantially interwoven fiber orientation in an injection molded thermoplastic matrix, wherein the fibers display no preferential orientation and a high degree of entanglement beneficial to the preparation of molded articles which experience complex loading in actual use.

PRIOR ART

The use of long fiber reinforced thermoplastics for injection molding has grown in recent years, along with its associated and identified problems, the most critical and most often addressed being the problem of fiber degradation.

For instance, during injection molding, polymer material is plasticated, melted and metered, however, the impregnated fiber is known to experience degradation during this process. The majority of fiber degradation typically occurs at the first part of the transition zone in the injection molding screw. The injection phase has also been shown to be a large contributor to fiber breakage during the overall cycle. Fiber breakage during injection molding is also seen to occur at the nozzle of the injection molding machinery, and to a greater extent, at the gate.

Furthermore, with regards to details of fiber degradation, it has more or less been categorized into three basic mechanisms: fiber/fiber, fiber/equipment, and fiber matrix interactions. That is, each of these have been shown to combine and contribute to the overall fiber degradation mechanism during the injection molding cycle. See, e.g. "Fiber Degradation During the Reciprocating Screw Plasticization," Doctoral Thesis, University of Massachusetts, Lowell (1992).

Not surprisingly, therefore, various solutions have been advanced with regards to controlling and minimizing fiber degradation. For example, it is generally known that the use of a constant taper or low compression screw actually increases the amount of fiber degradation. In addition, mold design modifications to minimize degradation include: increased venting, short polished sprue, full round runners, large gates, and hardened surfaces. In addition, the gate should be made as large as reasonable for a given part based on material cost and aesthetics as well as cycle time and economics.

Additionally, in some cases, simple processing variations can be made in order to reduce fiber degradation, obviating any need to modify the injection molding machine, or the mold itself. For example, increased screw speed subjects material to increased shear and thus increases fiber degradation in injection molded parts. Accordingly, lower screw speeds are desirable. Similarly, high injection speeds lead to increased shear, and degradation. Therefore, lower injection speeds may contribute to a reduction in fiber destruction.

What emerges, therefore, from the above review of the prior art is that the industry has correctly and properly focused on the preparation of fiber-impregnated thermoplastic parts wherein a number of variables have been explored to minimize degradation of the fibers themselves. Certainly, to the extent that any success is within reach with regards to the preparation of fiber-impregnated injection molded thermoplastics, degradation must be minimized.

In addition to the above, it is also worth noting that studies have been done which focus on the distribution of fibers in the injection molded samples themselves. This is so since fiber orientation can and will affect the strength of the composite material. For example, fiber length for certain long fiber thermoplastics were seen to indicate, under identified procedures, a bi-modal distribution. That is, the fiber length near the wall was found to be shorter than the fiber length in the core region. See, e.g. "Composite Materials Technology Process and Properties," Hanser Publishers, New York, 1990.

In addition, it should be noted that in the context of the present invention which finds enhanced utility in a shoe application, a portion of the prior art has indeed focused on the preparation of fiber-impregnated plastic materials, specifically for the purpose of preparing a toe cap insert for what is known as protective shoe. Attention is therefore directed to the following United States and foreign patents and/or applications which collectively describe the development of composite type plastic materials specifically for protective shoe manufacture: U.S. Pat. Nos. 5,331,751; 5,210,963; 4,735,003; 4,103,438; 3,950,865; 3,045,367; 2,740,209; European Patent Application 83304046.2; European Patent No. 0095061; and U.K. Patent Application Nos. 2,071,989 and 2,138,272.

Accordingly, the above review demonstrates that there is a continuing need in the plastics industry for a fiber-impregnated injection molded thermoplastic part wherein fiber degradation is minimized, or for that matter eliminated entirely. In addition, given the importance of fiber orientation, there is also a critical need for a procedure whereby fiber orientation is simultaneously managed to optimize mechanical properties for a given application.

Therefore, it is an object of this invention to overcome the disadvantages of the prior art and prepare a long fiber reinforced injection molded plastic part, wherein fiber degradation is substantially avoided, and wherein a substantially interwoven fiber orientation is developed in the thermoplastic matrix thereby improving and optimizing resistance to complex mechanical loading.

It is also an object of the present invention to prepare a long fiber reinforced injection molded thermoplastic part, wherein the fibers display no preferential orientation, along with a high degree of fiber entanglement, and in conjunction with the development of such product, to identify a process for manufacture thereof.

Finally, and more specifically, it is also an object of this invention to prepare a long fiber reinforced injection molded thermoplastic part particularly adapted as an insert toe cap for a protective shoe, although other utilities are fully contemplated and fall within the broad scope of the molded plastic/interwoven and impregnated composite fiber invention disclosed herein.

SUMMARY OF THE INVENTION

An injection molded fiber-impregnated plastic composite material comprising a thermoplastic polymer matrix wherein the fibers are sufficiently interwoven and entangled in said polymer matrix to provide improved resistance to mechanical loading. In particular, the present invention describes an injection molded toe cap for a protective shoe of the type having a rearwardly opening shoe toe-shaped body including a roof which blends smoothly into opposite lateral generally vertical side walls (e.g., by the use of a rounded edge) and a generally vertical front wall, and an open rear edge end defined by a rear edge including the rear edges of the roof and said walls, said toe cap comprising a fiber-impregnated plastic resin body having a major portion of the fibers in the resin portion forming an interwoven and entangled orientation throughout. Furthermore, in process form, the present invention describes the preparation of an injection molded-fiber impregnated plastic composite material containing a substantially interwoven fiber orientation comprising supplying of a fiber-impregnated thermoplastic resin pellet, and injection molding said pellet, wherein the level of fiber impregnation, fiber length, fiber diameter, viscosity of the thermoplastic resin, molding temperature, injection time, and wall thickness of the composite material subsequent to the molding procedure are adjusted to provide a substantially interwoven fiber orientation.

DETAILED DESCRIPTION OF PREFERRED EMBODIMENTS

As noted, the present invention comprises an injection molded fiber-impregnated plastic composite material comprising a thermoplastic polymer matrix wherein the fibers are sufficiently interwoven and entangled in said polymer matrix to provide resistance to mechanical loading. In this regard, it will be appreciated by those skilled in the art that by the interwoven and entangled configuration of the composite fibers a "bird's nest" orientation of the fibers is present, and such orientation provides in the part an enhanced resistance to complex mechanical loading. That is, regardless of what specific type of mechanical loading is applied to the composite, the fibers are without preferential orientation, and therefore, a portion of the fibers can always serve to increase the mechanical strength of the part, in the direction of the randomly applied load. More particularly, the interwoven and entangled fibers increase the flexural modulus of the composite and said composite distributes and carries an applied load in multi-directions.

Furthermore, it has been found that suitable plastic materials for preparing the composite material described herein are preferentially those plastic materials which lend themselves to injection molding. Preferably, the plastic materials comprise nylon-6, nylon-6,6, or a thermoplastic polyurethane resin. However, other types of thermoplastic materials would be suitable provided they interact with the fibers in such a way to provide the appropriate flow behavior in the injection molding cycle to cause the "bird's nest" interwoven orientation of the fibers upon cooling.

With regards to the fibers found suitable for the composite material described therein, glass type fibers, generally known as "S Glass" and "E Glass" have been found suitable, and are present in the composite at levels of about 40–60% by weight. Preferably, the fibers are present in the neighborhood of 50–60% by weight, and the precise level of fiber can be adjusted to maximize mechanical performance. In addition, the fibers are generally about 0.5–1.0 inches in length, and such length of fiber is conveniently and best provided in pellets of the same dimension. Such pellets containing a fiber length that is similar to pellet length is preferably achieved by the process of pultrusion, and in a preferred embodiment such pellets of the thermoplastic polyurethane variety are available from DSM, Inc. In particular, the most preferred thermoplastic polyurethane is sold under the designation DSM G-108, which contains 50% fiber content (E-glass) and a 0.5–1.0 inch pellet length.

In regards to the processing equipment found suitable for the preparation of the composite material described herein, it has been found preferable to outfit the injection molding machine with an easy flow tip and nozzle along with a large screw which are all commercially available from Injection Molding Supply, Inc. In accordance with the present invention, it is preferable to develop easy flow and low pressure drops in the mold, for the purposes of providing the least fiber damage. Listed below in Table 1 are the material specifications for the preferred resins, followed by Table 2, which details the preferred molding profiles:

TABLE 1

Thermoplastic Material Data

| Mat./Prop. | RTP VLF 80211 | DSM 50% Nylon-6,6G-1/50 | LNP Verton ® RF-700-10 | Cellstran ® PPG50 | Cellstran ® PUG60-01-4 | DSM G-108PUR |
|---|---|---|---|---|---|---|
| Base resin | Nylon-6,6 | Nylon-6,6 | Nylon-6,6 | Polypropylene | PUR | PUR |
| Fiber Content (%) | 60 | 50 | 50 | 50 | 60 | 50 |
| Sp. Gravity | 1.7 | 1.57 | 1.57 | 1.33 | 1.76 | 1.63 |
| Molding Shrinkage (in/in) @ 1/8 in. | 2E-3 | 2E-3 | 3.5E-3 | | | 1E-3 |
| Water Absorption % (24 hrs. @ 23 C.) | 0.48 | NA | 4 | | | |
| Notched Izod Impact Strength (ft lb/in) | 8 | 5.7 | 6 | | 14 | 9 |
| Tensile Strength (psi) | 40,000 | 37,000 | 37,000 | | 34,000 | 33,000 |
| Tensile Elongation (%) | 3 | 2 | 4 | | | 2.3 |
| Tensile Modulus (psi) | 3.0E6 | 2.5E6 | | | | 1.9E6 |
| Flexural Strength (psi) | 58,000 | 55,000 | 58,000 | | | 47,000 |

TABLE 1-continued

Thermoplastic Material Data

| Mat./Prop. | RTP VLF 80211 | DSM 50% Nylon-6,6G-1/50 | LNP Verton ® RF-700-10 | Cellstran ® PPG50 | Cellstran ® PUG60-01-4 | DSM G-108PUR |
|---|---|---|---|---|---|---|
| Flexural Modulus (psi) | 2.8E6 | 2.2E6 | 2.3E6 | | 2.4E6 | 1.8E6 |
| HDT (F@264 psi) | 500 | 505 | 470 | | 210 | 220 |

Note 1: Verton ® is a registered trademark of LNP Co., and S-2 glass ® is a registered trademark of Owens-Corning Fiberglass Co., and Cellstran ® is a registered trademark of Hoechst Celanese.
Note 2: No material properties available for Specialty compounds from Owens-Corning Fiberglass.

Note 1: Verton® is a registered trademark of LNP Co., and S-2 glass® is a registered trademark of Owens-Corning Fiberglass Co., and Cellstran® is a registered trademark of Hoechst Celanese.
Note 2: No material properties available for Specialty compounds from Owens-Corning Fiberglass.

Shear Rate($\gamma$)=V/h: where V=Velocity and h=Cavity thickness with and injection speed of 40% (4 in/sec) we get 1.6 in/sec and h/2=0.225/2 in Therefore $\gamma$=14.2 $sec^{-1}$ With regards to mold design, as in the case of the design and selection of injection molding equipment, the mold should be designed to provide easy flow with minimum fiber damage. In this regard, thick runners are preferably used to minimize pressure drops in the mold, which result in minimum fiber breakage and heat loss. The diameter of the runner is generally about 10.25–0.50 inches, and preferably, 0.375 inches.

TABLE 2

Processing Conditions

| | RTP VLF 80211 | DSM 50% Nylon-6,6G-1/50 | LNP Verton ® RF-700-10 | LNP Verton ® RF-700-12 | Cellstran ® PUG60-01-4 | DSM G-108PUR | Owens-Corning Specialty Compound with 50% S-2 glass ® fiber |
|---|---|---|---|---|---|---|---|
| Screw Speed (RPM) | 25 | 25 | 25 | 25 | 25 | 25 | 25 |
| Injection Pressure (%) | 65 | 65 | 65 | 65 | 60 | 60 | 65 |
| Injection Speed (%) | 40 | 40 | 40 | 40 | 50 | 50 | 40 |
| Mold Temp C. (F.) | 104(220) | 104(220) | 104(220) | 104(220) | 88(190) | 88(190) | 104(220) |
| Injection Time (s) | 2.5 | 2.5 | 2.5 | 2.5 | 3 | 3 | 2.5 |
| Hold Time (s) | 10 | 10 | 10 | 10 | 10 | 10 | 10 |
| Holding Pressure (%) | 40 | 40 | 40 | 40 | 20 | 20 | 40 |
| Cooling Time (s) | 20 | 20 | 20 | 20 | 30 | 30 | 20 |
| Decomp. (s) | 0.3 | 0.3 | 0.3 | 0.3 | 0.3 | 0.3 | 0.3 |
| Temp. C. (F.) | 271(520) | 271(520) | 271(520) | 271(520) | 227(440) | 227(440) | 271(520) |
| Zone 1 | 288(550) | 288(550) | 288(550) | 288(550) | 232(450) | 232(450) | 288(550) |
| Zone 2 | 293(560) | 293(560) | 293(560) | 293(560) | 238(460) | 238(460) | 293(560) |
| Nozzle Melt | 288–293 (550–560) | 288–293 (550–560) | 288–293 (550–560) | 288–293 (550–560) | 232–238 (450–460) | 232–238 (450–460) | 288–293 (550–560) |

Note 1: Verton ® is a registered trademark of LNP Co., and S-2 glass ® is a registered trademark of Owens-Corning Fiberglass Co., and Cellstran ® is a registered trademark of Hoechst Cellanese.
Note 2: Maximum injection pressure is 2,000 psi cylinder pressure, and maximum injection speed is 4.0 in/sec.
Note 3: All Materials were dried at 82 C. (180 F.) for 4 hours prior to molding.

The overall cycle time for these materials can be determined by utilizing the processing parameters. For the nylons the cycle times were all the same and for the polyurethane they were all the same. From the data above the cycle times were 32.8 sec and 43.3 sec for the nylon-6,6 and polyurethane respectively. This does not include the time for mold close and open. Therefore the total cycle times were about 40 sec for the nylon-6,6 and 48 sec for the polyurethane.

The shear rate in the mold was also of great importance. The highest shear rates would be found in the thinnest cross section of the molding. Therefore, the shear rate in the mold cavity was calculated.

With regards to the gating of the mold, the gate is preferentially streamlined, meaning that no sharp corners or restrictions should be present to therefore provide a smooth transition zone during filling. Preferably, the thickness of the gate is approximately equal to the part thickness and such gating allows sufficient packing and avoids premature freeze off of the injection molded composite. Listed below in Table 3 are the preferential machine specifications.

TABLE 3

| Machine Specifications | | |
|---|---|---|
| Cincinnati | | |
| Screw Dia. (In.) | 1.6 | |
| Flighted Length (In.) | 32.5 | |
| L/D | 20.1 | |
| Compression Ratio | 2.6:1 | |
| Screw Type | Square Pitch Metering Screw | |
| Flight Width (in.) | 0.2 | |
| Flight Clearance (in.) | 0.0 | |
| Turn | | Channel Depth (in.) |
| Feed Section | 0–10 | 0.26 |
| Transition Section | 11.0 | 0.238 |
| | 12.0 | 0.213 |
| | 13.0 | 0.175 |
| | 14.0 | 0.143 |
| | 15.0 | 0.112 |
| Metering Section | 16–20 | 0.103 |
| | * * * * * * | |
| Testing | | |

An investigation of a new safety shoe application was done by following ANSI Z-41 (1991). Molded safety shoe toe caps were tested based on this protocol. The protocol calls for impact and compression testing of molded safety shoe toe caps incorporated into shoes. A prototype injection mold was produced in order to mold samples to be tested. The mold was a single cavity cast bronze/aluminum alloy. The design went through three iterations, each with a different gate size. The mold design was done in order to minimize the degradation of the fibers during injection as discussed previously. Therefore, the part was sprue gated and only one right angle turn into the cavity was used. The ANSI Z-41 standards for safety shoe toe protection are as follows from ANSI Z-41 (1991):

TABLE 4

| ANSI Z-41 Standards |
|---|
| Impact |
| I/75 = 101.7J (75 ft. lbf) |
| I/50 = 67.8J (50 ft. lbf) |
| I/30 = 40.7J (30 ft. lbf) |
| Compression |
| C/75 = 11,121 N (2500 lb) |
| C/50 = 7,784 N (1750 lb) |
| C/30 = 4,448 N (1000 lb) |
| Clearance is: |
| Men - 12.7 mm (16/32 in) |
| Women - 11.9 mm (15.32 in) for all tests. |

Testing was done in accordance with ANSI-41 (1991) standards for safety shoe footwear, and the results are listed below in Table 5:

TABLE 5

ANZI Z-41 Testing Results

| Material | Impact Clearance (I/75) | Compression Load (lb) @ 0.5 inch clearance | Cycle Time (min.sec) |
|---|---|---|---|
| Lewcott Specialty pre-preg FM-2 | Cracked and cut clay (<0.5 in) | NA | 20.0 |
| Owens-Corning SDB 120 | Cracked and deformed (<0.5 in.) | NA | 10.0 |
| Owens-Corning DB 170 | Cracked and deformed (<0.5 in.) | NA | 10.0 |
| DMS G-108 Polyurethane | .64 | 2,600 | 0.48 |
| PCI PUG60-01-4 Polyurethane | .70 | 2,940 | 0.48 |
| Cellstran ® PPG-50 Polypropylene | <0.5 | 1,750 | 0.48 |
| RTP 80211 50% long glass fiber Nylon-6,6 | Not Tested in shoe Cracked out of shoe | — | 0.36 |
| DSM G-1/50 50% long glass fiber Nylon-6,6 | Not Tested in shoe Cracked out of shoe | — | 0.36 |
| Owens-Corning S-2 Glass ® Nylon-6,6 | .875 | 3,300 | 0.36 |
| LNP Verton ® RF-700-10 Nylon-6,6 | Not tested in shoe Cracked out of shoe | — | 0.36 |

Note: Verton® is a registered trademark of LNP Co., and S-2 glass® is a registered trademark of Owens-Corning Fiberglass Co., and Cellstran® is a registered trademark of Hoechst Cellanese.

It should be noted that the toe cap of the present invention may be molded to any conventional style and shape of toe cap, and which include a rearwardly opening shoe, toe-shaped body having a roof which blends smoothly in curved transition regions into opposite lateral generally vertical side walls (e.g., by a rounded edge) and a generally vertical front wall to define a conventional toe cap body. The body is made of the molded fiber-impregnated thermoplastic composite material described herein wherein the fibers are interwoven and entangled to provide resistance to mechanical loading.

In addition, the injection molded toe cap for a protected shoe of the present invention has an additional feature: a tapering of the roof (i.e. a feathering to a thinner edge) at the open rear edge relative to the thickness of the roof approximate to the vertical front wall of the toe cap. It has been found that this tapering is a particularly preferred design since computerized structural analysis of a toe cap has indicated that the rear edge is not as load-bearing as the remainder of the body of the toe cap. In fact, by tapering, the rear edge is made relatively more flexible during complex loading which uniquely serves to dissipate energy more efficiently without failure. In addition, there has been found to be a cosmetic benefit to a tapered rear edge, namely the toe cap does not give birth to a shoe line which can be seen through the leather or other material that is commonly used in a safety shoe manufacture.

In process form, the present invention comprises a method for the preparation of an injection molded fiber-impregnated thermoplastic composite material containing a substantially interwoven fiber orientation comprising supplying of a fiber-impregnated thermoplastic resin pellet and injection molding said pellet, wherein the level of fiber impregnation, fiber length, fiber diameter, viscosity of the thermoplastic resin, molding temperature, injection time, and wall thickness of the composite material to be molded are adjusted to develop a substantially interwoven fiber orientation in the thermoplastic composite material subsequent to molding. Preferably, the impregnated thermoplastic composite material contains a level of fiber impregnation of about 40–60%. In addition, the fiber-impregnated thermoplastic composite material contains a fiber length of about 0.5–1.0 inches. Preferably, the pellet diameter is about 0.125 inch. Molding temperatures are preferably about 460° C. for polyurethene and 560° C. for nylon/polyamides. Furthermore, the wall thickness of the part produced is preferably 0.150 inches. Accordingly, by varying the above-mentioned parameters, and preferably, varying said parameters within the ranges so indicated (see, e.g., Table 2), a substantially interwoven fiber orientation in an injection molded thermoplastic material can be produced.

In sum, various modes of carrying out the present invention are contemplated as being within the scope of the following claims particularly pointing out and distinctly claiming the subject matter described herein.

What is claimed is:

1. An injection molded toe cap for a protective shoe having a rearwardly opening shoe toe-shaped body including a roof which blends smoothly into opposite lateral generally vertical side walls, said roof and said side walls having a thickness of at least 0.075 inch, and a generally vertical front wall, and an open rear edge end defined by a rear edge of said roof and said vertical side walls, said toe cap consisting essentially of a one-shot injection molded fiber-impregnated thermoplastic resin layer having a major portion of the fibers in the resin portion consisting essentially of a substantially interwoven and entangled orientation throughout wherein said fibers prior to injection molding are between about 0.50–1 inches in length and said fibers are present at a level of at least 40% by weight, and said toe cap consisting essentially of a one-shot injection molded fiber-impregnated thermoplastic resin layer passes ANSI Z-41 testing standards for safety shoe protection.

2. The injection molded toe cap for a protective shoe of claim 1, wherein the fiber is S-glass or E-glass.

3. The injection molded toe cap for a protective shoe of claim 1, wherein the open rear-edge of the roof is tapered relative to the thickness of said roof proximate to said vertical front wall.

4. The injection molded toe cap of claim 1 wherein said molded thermoplastic resin is nylon-6, nylon-6,6 or a polyurethane.

5. The injection molded toe cap of claim 1 wherein said roof and side wall thickness is at least 0.125 inches.

6. The injection molded toe cap of claim 1 wherein said roof and side wall thickness is at least 0.20 inches.

7. The injection molded toe cap of claim 1 wherein said fiber is present at a level of about 40–60%.

8. The injection molded toe cap of claim 1, wherein said open rear edge of the roof is tapered relative to the thickness of said roof proximate to said vertical front wall.

* * * * *